US012448875B2

(12) United States Patent
Lowe et al.

(10) Patent No.: US 12,448,875 B2
(45) Date of Patent: Oct. 21, 2025

(54) COMPACT IGNITER

(71) Applicant: Schlumberger Technology Corporation, Sugar Land, TX (US)

(72) Inventors: Erick Lowe, Clamart (FR); Hari Prakash Kalakonda, Pune (IN)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/725,243

(22) PCT Filed: Feb. 8, 2023

(86) PCT No.: PCT/US2023/012575
§ 371 (c)(1),
(2) Date: Jun. 28, 2024

(87) PCT Pub. No.: WO2023/154306
PCT Pub. Date: Aug. 17, 2023

(65) Prior Publication Data

US 2025/0109667 A1 Apr. 3, 2025

Related U.S. Application Data

(60) Provisional application No. 63/308,288, filed on Feb. 9, 2022.

(30) Foreign Application Priority Data

Feb. 8, 2022 (IN) ..... 202221006610

(51) Int. Cl.
*E21B 43/1185* (2006.01)

(52) U.S. Cl.
CPC ..... *E21B 43/1185* (2013.01)

(58) Field of Classification Search
CPC ..... F42B 3/121; E21B 43/1185; E21B 43/11857; E21B 23/065; F42D 1/02; F42D 3/04
See application file for complete search history.

(56) References Cited

U.S. PATENT DOCUMENTS 6,166,452 A * 12/2000 Adams ..... F42B 3/121 361/247
6,463,857 B1 10/2002 Schmid
(Continued)

OTHER PUBLICATIONS

Search Report and Written Opinion of International Patent Application No. PCT/US2023/012575 dated May 31, 2023, 8 pages.

*Primary Examiner* — Daniel P Stephenson
(74) *Attorney, Agent, or Firm* — Jeffrey D. Frantz

(57) ABSTRACT

An igniter is described herein. The igniter comprises a housing having a first part with a circuit guide and a second part that fits together with the first part to form the housing, the first part and the second part defining an interior of the housing, with the circuit guide located in the interior of the housing; an ignition circuit having a heating element disposed within the interior of the housing, a first lead, and a second lead, the first lead and the second lead extending outside the housing; a power contact electrically connected to the first lead through a power opening in the housing; and a ground member disposed around the housing in electrical contact with the second lead.

17 Claims, 6 Drawing Sheets

(56) References Cited

U.S. PATENT DOCUMENTS

| | | | | |
|---|---|---|---|---|
| 10,584,950 | B2 * | 3/2020 | Saltarelli | F42C 15/34 |
| 2002/0166471 | A1 | 11/2002 | Goernig | |
| 2015/0345922 | A1 | 12/2015 | Lanclos | |
| 2019/0106969 | A1 | 4/2019 | Sullivan | |
| 2021/0164331 | A1 | 6/2021 | Sokolove | |
| 2024/0209704 | A1 * | 6/2024 | Morrison | E21B 23/065 |
| 2024/0218755 | A1 * | 7/2024 | Morrison | E21B 36/04 |
| 2024/0318526 | A1 * | 9/2024 | Zakharia | E21B 23/065 |
| 2025/0109667 | A1 * | 4/2025 | Lowe | E21B 43/1185 |

* cited by examiner

COMPACT IGNITER

CROSS-REFERENCE TO RELATED APPLICATIONS

This application is a National Stage Entry of International Patent Application No. PCT/US2023/012575, filed Feb. 8, 2023, which claims benefit of U.S. Provisional Patent Application No. 63/308,288, filed on Feb. 9, 2022, which is incorporated herein by reference. This application also claims benefit of Indian Patent Application No. 202221006610, filed on Feb. 8, 2022.

TECHNICAL FIELD

This patent application describes an ignition apparatus for use in completing hydrocarbon production wells. Specifically, a compact igniter design is described.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statement are to be read in this light, and not as admissions of prior art.

Igniters are used in tools for subterranean prospecting where an explosive discharge is needed. The igniter contains a small quantity of combustible material, such as black powder, and an electrical circuit with a resistor to apply heat to the combustible material. The igniter produces a discharge of combustion products that can be used to activate other combustion-based components, such as shaped charges used for perforation and detonation cords used to transfer ballistic discharge.

Igniters usually have a spring that is used to conduct electricity into a housing that holds the combustible material and the resistor. The resistor is connected to a ground path to provide electrical continuity. Often, the housing is metal, the resistor is connected to the housing for ground, and the spring is insulated from the housing, for example by a plug.

Conventional igniters are difficult and time consuming to assemble. There is a need for igniters that are quick and easy to assemble.

SUMMARY

Certain embodiments commensurate in scope with the originally claimed disclosure are summarized below. These embodiments are not intended to limit the scope of the claimed disclosure, but rather these embodiments are intended only to provide a brief summary of possible forms of the disclosure. Indeed, embodiments may encompass a variety of forms that may be similar to or different from the embodiments set forth below.

Embodiments described herein provide an igniter, comprising a housing having a first part with a circuit guide and a second part that fits together with the first part to form the housing, the first part and the second part defining an interior of the housing, with the circuit guide located in the interior of the housing; an ignition circuit having a heating element disposed within the interior of the housing, a first lead, and a second lead, the first lead and the second lead extending outside the housing; a power contact electrically connected to the first lead through a power opening in the housing; and a ground member disposed around the housing in electrical contact with the second lead.

Other embodiments described herein provide an igniter, comprising a housing having a first part and a second part, the first part and the second part being separable and defining an interior of the housing, the housing having a partition in the interior of the housing that defines an electrical connection chamber within the interior to provide electrical connection to a power source and a combustion chamber within the interior to contain a combustible material, the partition having a lead opening that provides a passage between the electrical connection chamber and the combustion chamber; an ignition circuit having a heating element, a first lead, and a second lead, the ignition circuit disposed within the interior of the housing with the heating element located within the combustion chamber and the first lead extending through the lead opening of the partition into the electrical connection chamber; a power contact disposed within the electrical connection chamber, extending outside the housing through a power opening of the housing, and electrically connected with the first lead; and a ground member electrically connected with the second lead.

Other embodiments described herein provide an igniter, comprising a housing having a first part and a second part, the first part and the second part defining two parts of a cylinder divided longitudinally and being connected along a long edge thereof in a clamshell configuration, the first part and second part defining an interior of the housing, the housing having a partition in the interior of the housing that defines an electrical connection chamber within the interior to provide electrical connection to a power source and a combustion chamber within the interior to contain a combustible material, the partition having a lead opening that provides a passage between the electrical connection chamber and the combustion chamber in an axial direction, the housing having a ground opening in a side wall thereof that provides a passage from the combustion chamber to an exterior of the housing in a radial direction; an ignition circuit having a heating element, a first lead, and a second lead, the ignition circuit disposed within the interior of the housing with the heating element located within the combustion chamber, the first lead extending through the lead opening of the partition into the electrical connection chamber, and the second lead extending through the ground opening; a power contact disposed within the electrical connection chamber, extending outside the housing through a power opening of the housing, and electrically connected with the first lead; and a ground member electrically connected with the second lead . . .

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

One or more specific embodiments will be described below. In an effort to provide a concise description of these embodiments, all features of an actual implementation may not be described in the specification. It should be appreciated that in the development of any actual implementation, as in any engineering or design project, numerous implementation-specific decisions are made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Furthermore, any numerical examples in the following discussion are intended to be non-limiting, and thus additional numerical values, ranges, and percentages are within the scope of the disclosed embodiments.

The igniters described herein feature a two-part housing that enables easy assembly. The parts of the housing are designed such that an electrical circuit comprising a heating element can be easily arranged with a combustible material, and such that closure of the housing and final assembly connects the circuit to a ground path.

Figure 1A:
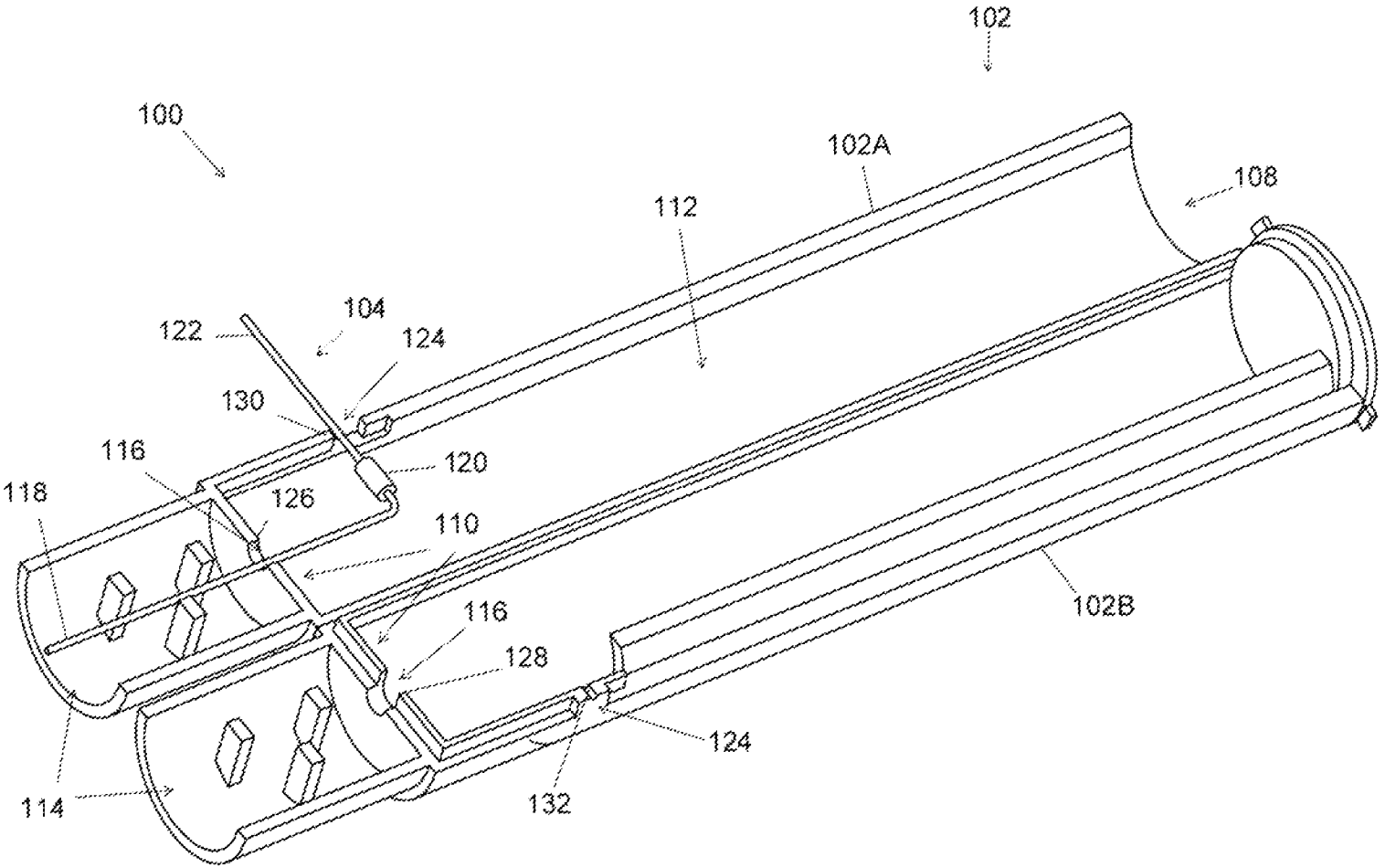
FIG. 1A is an isometric view of an igniter in a first stage of assembly, in accordance with embodiments of the present disclosure.

FIG. 1A is an isometric view of a portion of an igniter 100, according to one embodiment. The igniter 100 comprises a housing 102, an ignition circuit 104, and a power contact 106 (shown in FIG. 1B). The housing 102 is in two parts, a first part 102A and a second part 102B, that when assembled form the housing 102. The first part 102A and the second part 102B are designed to fit together and to come apart in some manner to facilitate easy assembly of the igniter 100. The housing 102 has a cylindrical shape, and in this case the first part 102A and the second part 102B are two parts of the cylindrical housing 102, which is divided longitudinally, so each of the first part 102A and the second part 102B is a longitudinal portion of a cylindrical shape, with a rectangular profile along one axis and a semi-circular profile along another axis. The first part 102A and the second part 102B may each have the shape of a half-cylinder. The first part 102A and the second part 102B are, in this case, connected along a long edge of each part in a clamshell configuration. The first part 102A and the second part 102B can hinge along the connected edges to open and close.

When the two parts are closed to form the housing 102, the housing 102 has an interior 108. The housing has a partition 110 that extends across the interior 108 in a direction substantially perpendicular to a cylindrical axis of the housing 102 and divides the interior 108 into a combustion chamber 112 on one side of the partition 110 and an electrical connection chamber 114 on the other side of the partition 110. The partition 110 is in two parts here, with a portion of the partition 110 attached to each of the first part 102A and the second part 102B so that closing the parts 102A and 102B together forms the partition 110. The electrical connection chamber 114 is sized and configured to facilitate making electrical connection between the ignition circuit 104 and the power contact 106 within the electrical connection chamber 114. The combustion chamber 112 is sized and configured to house a combustible material, such as black powder, in a quantity selected to provide an ignition of suitable magnitude.

The ignition circuit 104 comprises a first lead 118, a heating element 120, and a second lead 122. The partition 110 has a lead opening 116 that provides a passage between the electrical connection chamber 114 and the combustion chamber 112. The first lead 118 is disposed through the lead opening 116, extending from the power contact 106, where the first lead 118 connects to the power contact 106 within the electrical connection chamber 114, to the heating element 120 disposed within the combustion chamber 112. In this case, the lead opening 116 provides passage in an axial direction of the housing 102 so that the first lead 118 is generally oriented axially with respect to the housing 102.

The housing 102 has a ground opening 124 formed in a side of the housing 102. The second lead 122 extends from the heating element 120 through the ground opening 124 to an exterior area outside the housing 102. The second lead 122 provides a ground pathway for the ignition circuit 104. Here, the lead opening 116 is defined by a first lead opening feature 126 of the first part 102A and a second lead opening feature 128 of the second part 102B, which fit together to form the lead opening 116 when the parts 102A and 102B are closed together. The ground opening 124 is likewise defined by a first ground opening feature 130 of the first part 102A and a second ground opening feature 132 of the second part 102B, which fit together to form the ground opening 124. In each case, the first features 126 and 130 are notches that, when the first part 102A is laid open with the notches facing upward, allow the ignition circuit 104 to be laid in the notches, with the first lead 118 laying in the notch that forms a part of the lead opening 116 and the second lead 122 laying in the notch that forms a part of the ground opening 124. The second part 102B can then be closed onto the first part 102A to capture the ignition circuit 104 within the housing 102 with the first and second leads 118 and 122 poised for making electrical connection.

The second lead opening feature 128 of the second part 102B is, in this case, also a notch that mates with the first lead opening feature 126 to form the lead opening 116. Each of the first and second lead opening features 126 and 128 are located near a longitudinal cylindrical axis of the respective part 102A and 102B, such that when the two parts 102A and 102B are closed together, the lead opening 116 is located near the central cylindrical axis of the housing 102.

The second ground opening feature 132 is, in this case, a tab with a notch formed at an end of the tab. When the first and second parts 102A and 102B are closed together, the second ground opening feature 132 extends into the first ground opening feature 130, as a tab into a notch, and the notch at the end of the tab engages with the notch in the first ground opening feature 130 to form the ground opening 124.

Figure 1B:
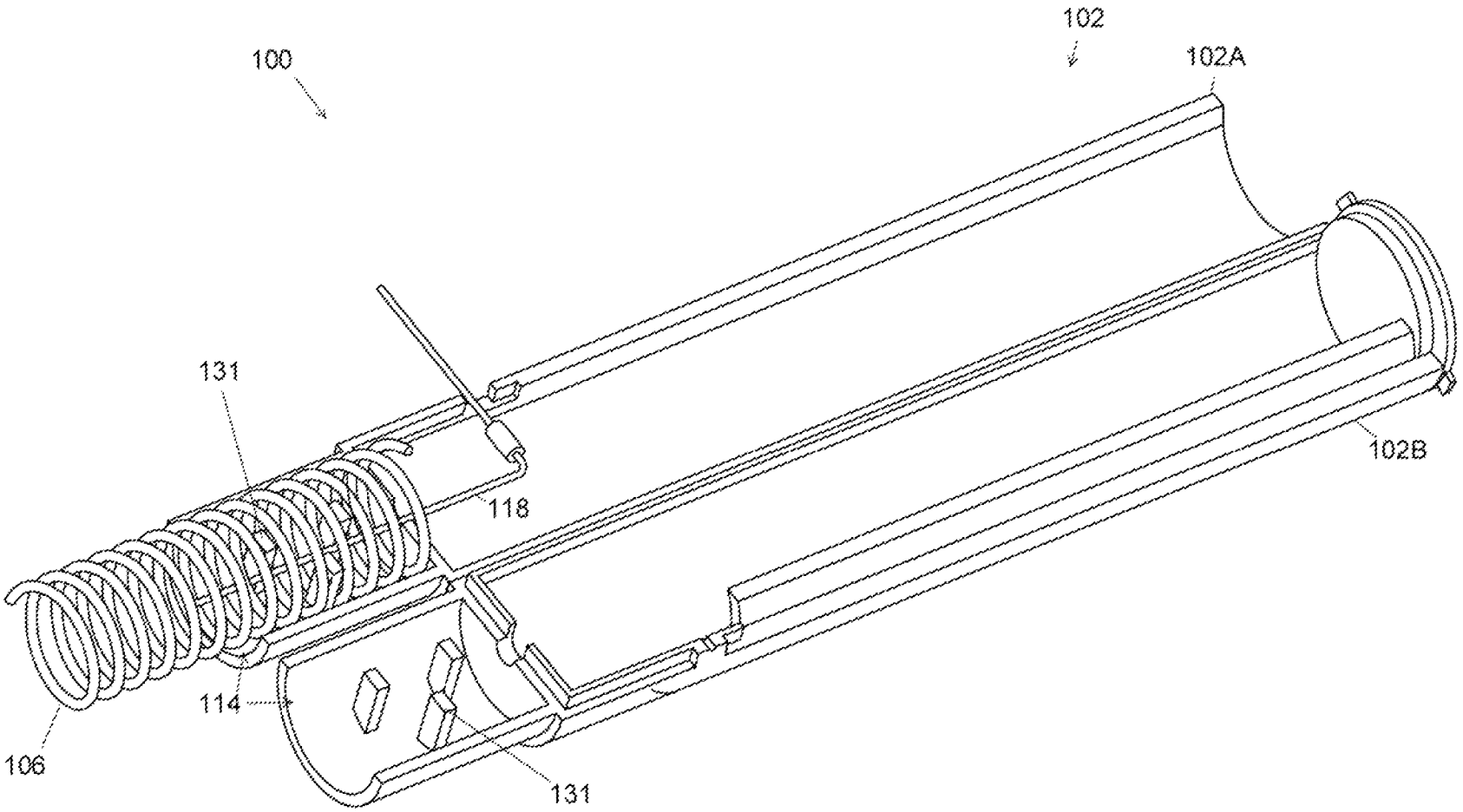
FIG. 1B is an isometric view of the igniter of FIG. 1A in a second stage of assembly, in accordance with embodiments of the present disclosure.

FIG. 1B is an isometric view of the portion of the igniter 100 of FIG. 1A with the power contact 106 placed into the housing 102. The power contact 106 is generally spring shaped to facilitate ease of making electrical contact with the first lead 118. The electrical connection chamber 114 can have one or more circuit guides 131 within the electrical connection chamber 114 to aid in positioning circuit components to facilitate electrical connection. In this case, each of the first part 102A and the second part 102B has a plurality of posts that protrude inward from the outer wall of the electrical connection chamber 114 into the interior in a generally radial direction. As shown here, some of the posts do not protrude in a precisely radial direction, but extend in a non-axial direction from one location of the outer wall toward another location of the outer wall. The posts are provided to facilitate placement of the power contact 106 within the portion of the first part 102A that helps form the electrical connection chamber 114 when the first part 102A and the second part 102B are closed together. When the power contact 106 is placed, the circuit guides 131 extend between loops of the power contact 106 to hold the power contact 106 in place while electrical connection is made between the power contact 106 and the first lead 118. The second part 102B also has circuit guides 131 in this case, so that when the second part 102B is closed with the first part 102A, the circuit guides 131 of the second part 102B also extend between loops of the power contact 106.

Electrical connection can be made between the power contact 106 and the first lead 118 before or after closing the housing 102. Here, the power contact 106 has no radial extension to make contact with the first lead 118 (see FIG. 2B), so a conductive material is added to make contact between the power contact 106 and the first lead 118. A conductive epoxy, or other flowable and settable conductive material can be used to make contact. In other cases, the power contact 106 can be configured in a spring shape, but with a radial extension designed to make contact with the first lead 118 when the power contact 106 is rotated to an appropriate extent. In such cases, connection between the power contact 106 and the first lead 118 can be made using the flowable, settable conductive material described above in more targeted fashion, for example just at the location where the power contact 106 touches the first lead 118. In such cases, the flowable, settable conductive material could be solder.

Figure 1C:
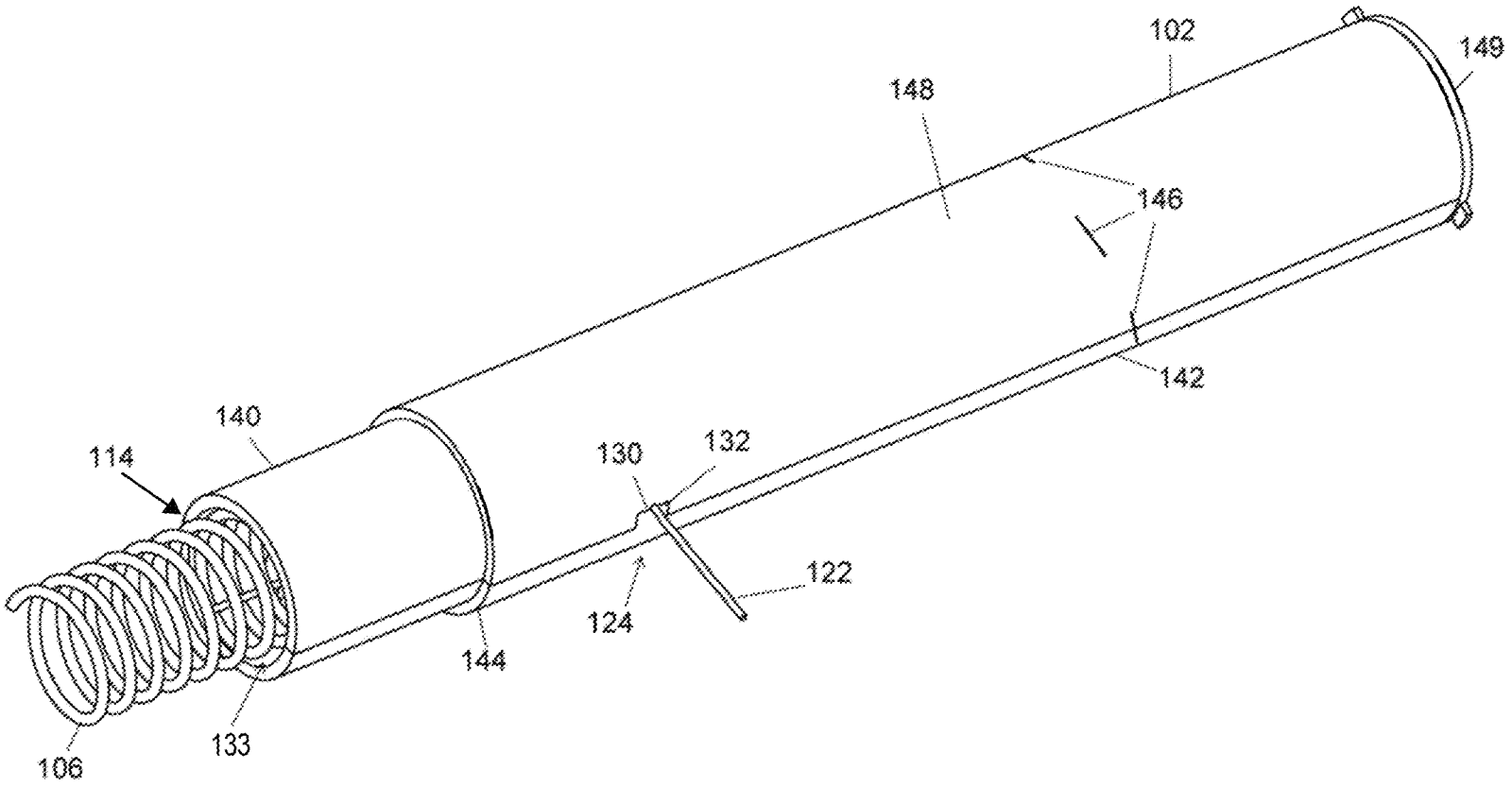
FIG. 1C is an isometric view of the igniter of FIGS. 1A and 1B in a third stage of assembly, in accordance with embodiments of the present disclosure.

FIG. 1C is an isometric view of the igniter portion of FIG. 1B in a closed configuration. The power contact 106 protrudes from the electrical connection chamber 114 through a power opening 133 at an end of the housing 102. The electrical connection chamber 114 is defined by the outer wall of the housing 102, the partition 110 (FIGS. 1A, 1B) at a first end of the electrical connection chamber 114, and the power opening 133 at a second end of the electrical connection chamber 114 opposite from the first end. The second lead 122 is shown protruding through the ground opening 124. The ground opening 124 is completed here by engagement of the tab, which is the second ground opening feature 132, with the notch, which is the first ground opening feature 130.

The housing 102 has two sections defined by two different diameters of the outer wall of the housing. A first section 140 of the housing 102 has a first diameter and a second section 142 of the housing 102 has a second diameter larger than the first diameter. The first and second sections 140 and 142 are joined at a shoulder 144, which extends around a circumference of the housing 102. The first section 140, in this case, approximately corresponds to the electrical connection chamber 114, while the second section 142 approximately corresponds to the combustion chamber 112. The shoulder 144 is located at a first axial location along the exterior of the housing 102. The partition 110 is located at a second axial location in the interior of the housing 102. In this case, the first axial location is the same as the second axial location. In other cases, the first axial location could be different from the second axial location.

The housing 102 has at least one catch 146 formed along the exterior surface 148 thereof to engage with a ground member described further below. There could be a plurality of catches 146 formed along the exterior surface 148. In this case, a plurality of catches 146 extends around the circumference of the housing 102 in the second section 142 of the housing 102. Each of the catches 146 is a groove formed in the exterior surface 148 or a slot formed through the exterior surface 148, and each catch 146 is oriented azimuthally (i.e. non-axially). In other cases, the catch 146 or catches 146 could be a hole or an axially oriented groove or slot. The catches 146 are here disposed along a circular circumference of the housing 102, but in other cases the catches 146 could be disposed with some axial displacement, one from another. That is, one azimuthally oriented catch 146 may be disposed along one circular circumference of the housing 102 while another azimuthally oriented catch 146 is disposed along a different circular circumference of the housing 102. Other arrangements of catches can also be used.

When the parts 102A and 102B are closed together, using the hinged clamshell configuration or an unconnected configuration where the parts merely fit together, the housing 102 is formed, the combustion chamber 112 is formed, and the electrical connection chamber 114 is formed. At that time, the combustion chamber 112 can be filled with combustible material. A closure 149 seals the open end of the combustion chamber 112, at an opposite end of the housing 102 from the power contact 106. The closure 149 can be any type of obstruction that closes the end of the combustion chamber 112. In this case, a cap is used for the closure 149.

The two parts 102A and 102B of the housing 102 are plastic, in this case, formed of a convenient plastic that can be molded or 3D-printed. As noted above, the two parts 102A and 102B are connected along one edge to form a hinged clamshell configuration. In other cases, the parts 102A and 102B can be unconnected, and can just fit together. Where necessary, catches or snaps can be formed into the parts 102A and 102B to hold the parts together after closure. The closure 149, in this case a cap, is also plastic. Where necessary or desirable, the closure 149 can have features that hold the parts 102A and 102B together. For example, the closure 149 could fit around the outside of the housing 102 instead of, or in addition to, the inside of the housing 102 as shown here. The closure 149 can be made of any convenient material, such as plastic, metal, rubber, or other material.

Figure 1D:
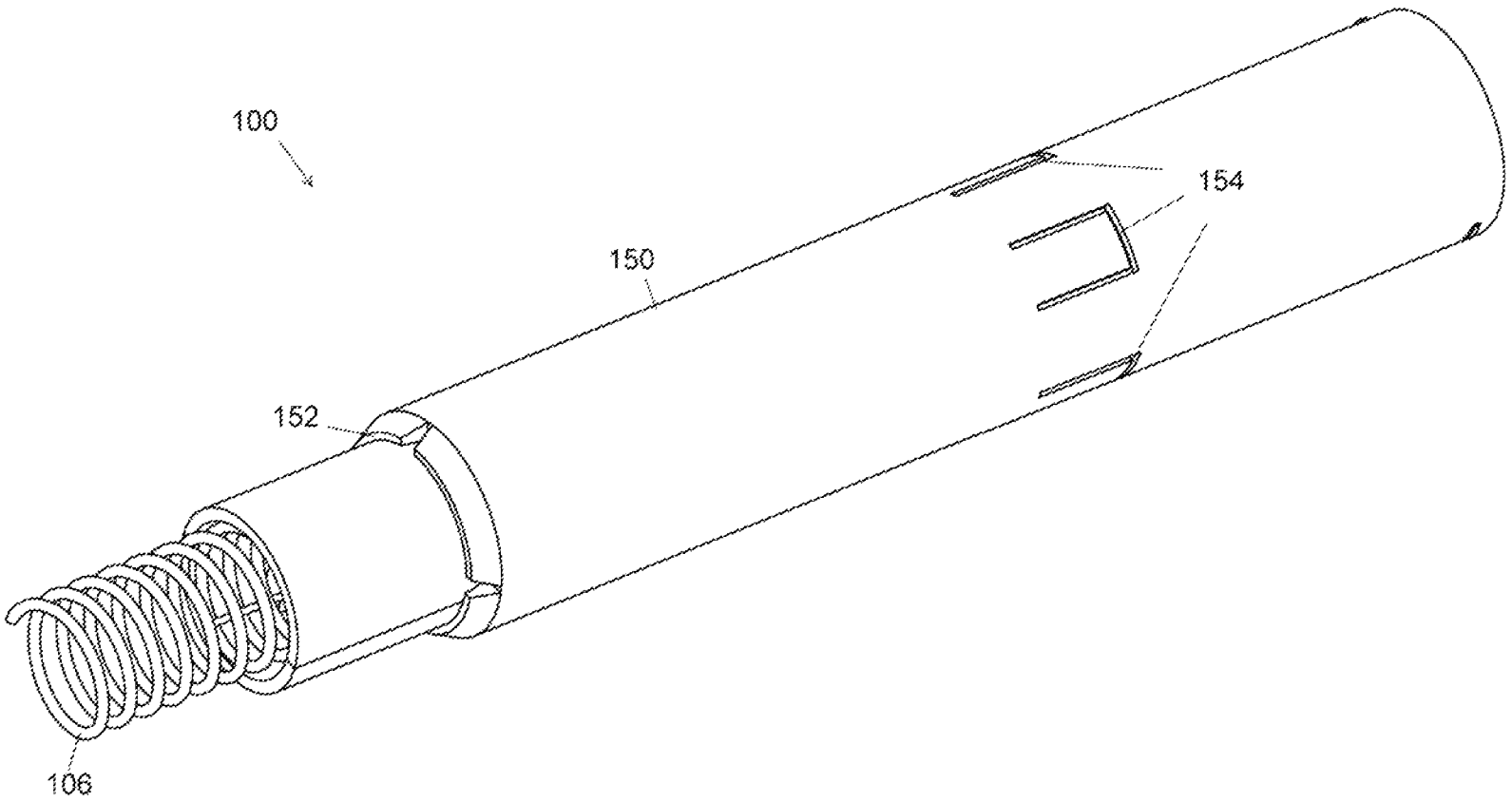
FIG. 1D is an isometric view of the igniter of FIGS. 1A-1C in a fourth stage of assembly, in accordance with embodiments of the present disclosure.

The fully assembled igniter includes a ground pathway for the second lead 122. FIG. 1D is an isometric view of the fully assembled igniter 100. A ground member 150 is disposed around the housing 102, mainly around the combustion chamber 112. The ground member 150 is conductive, and has a reduced diameter end 152 to engage with the shoulder 144 of the housing (FIG. 1C). The ground member 150 has a diameter slightly larger than the outer diameter of the housing 102 to allow the ground member 150 to slide along the housing 102. The reduced diameter end 152 may be a tapered diameter rim, or as in this case the reduced diameter end 152 may comprise a plurality of tabs bent toward the central axis of the cylindrical ground member. The reduced diameter end 152 allows the ground member 150 to be engaged by inserting the closed housing 102 at the full diameter end of the ground member 150 and sliding the ground member 150 along the housing 102 until the reduced diameter end 152 contacts the shoulder 144.

The ground member 150 has a plurality of fingers 154 to engage with the catches 146 when the ground member 150 has been moved to engage the reduced diameter end 152 with the shoulder 144. The engagement of the fingers 154 with the catches 146 secures the ground member 150 in position around the housing 102. Installation of the ground member 150 around the housing 102 captures the second lead 122 between the metallic ground member 150 and the plastic housing 102 making electrical contact between the second lead 122 and the ground member 150.

The ground member 150 provides a ground pathway for the second lead 122 and the ignition circuit 104. Thus, in operation, power can be applied to the power contact 106 to send electrical current through the heating element 120 of the ignition circuit 104 and the second lead 122 to the ground member 150. Electrical current passing through the heating element 120 causes the heating element 120 to release heat to the combustible material in the combustion chamber 112, resulting in ignition of the combustible material.

Figure 2A:
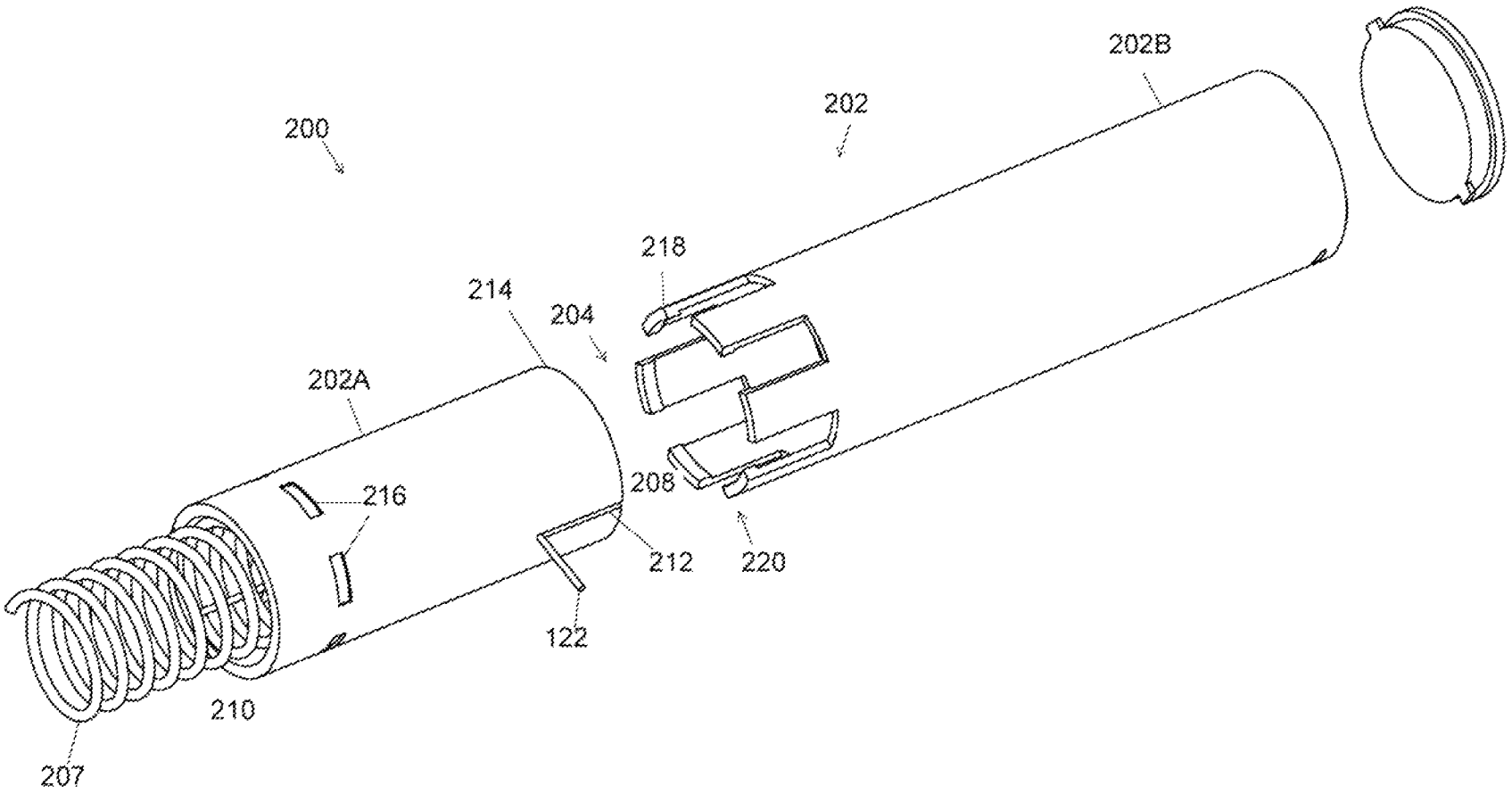
FIG. 2A is an isometric exploded view of an igniter, in accordance with embodiments of the present disclosure.
Figure 2B:
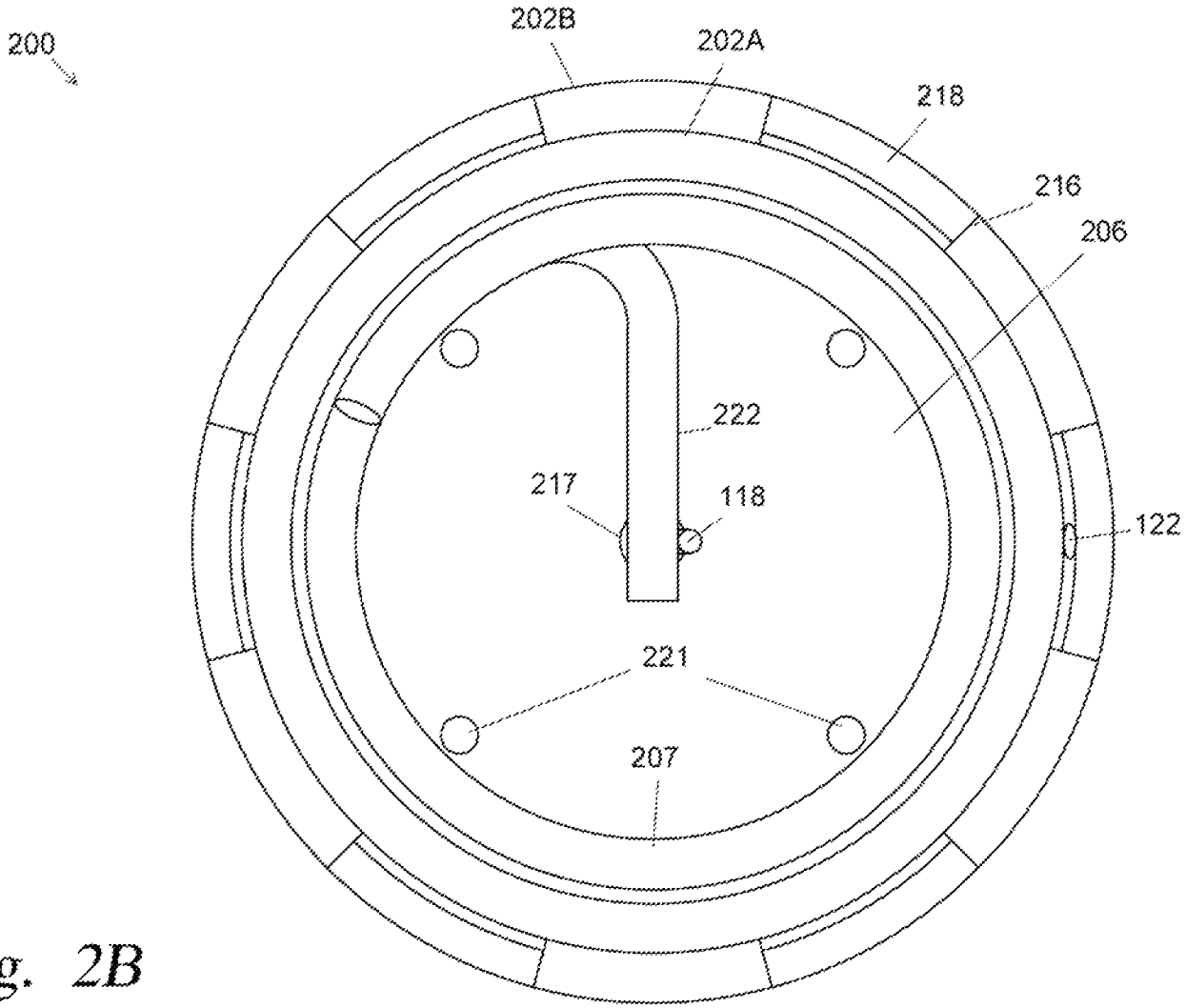
FIG. 2B is an end view of the igniter of FIG. 2A, in accordance with embodiments of the present disclosure.

FIG. 2A is an isometric exploded view of an igniter 200, according to another embodiment. FIG. 2B is an end view of the igniter 200. In this embodiment, a cylindrical housing 202 has a first part 202A and a second part 202B, but here the first part 202A and the second part 202B both have a generally cylindrical shape, with rectangular profile along one axis and circular profile along another axis. As with the igniter 100, the first part 202A and the second part 202B fit together to create the housing 202, with an interior 204. A partition 206 (FIG. 2B) divides the interior 204 into a combustion chamber 208 and an electrical connection chamber 210. In this case, the electrical connection chamber 210 is entirely defined by the first part 202A, and the combustion chamber 208 is defined by the assembly of the first part 202A and the second part 202B.

The first part 202A is designed to provide a pathway for the ignition circuit 104 to connect with a power contact 207 within the electrical connection chamber 210, similar to the arrangement of the igniter 100. In this case, however, the partition 206 is a member of the first part 202A only, and is not divided between the first part and the second part, as in the igniter 100. The first lead 118 is routed through a lead opening 217 (FIG. 2B) from the electrical connection chamber 210 to the heating element 120 disposed in the combustion chamber 208.

The first part 202A has a slot 212 formed in an end 214 of the first part 202A that engages with the second part 202B, when the first and second parts 202A and 202B are assembled to form the housing 202. The slot 212 extends in an axial direction of the igniter 200 from the end 214 of the first part 202A. The slot 212 provides a pathway for the second lead 122 to pass through the outer wall of the first part 202A to an exterior thereof.

The first part 202A has a first diameter. The second part 202B has a second diameter greater than the first diameter so the second part can fit over, and slide along the exterior of, the first part 202A. The first part 202A has a plurality of catches 216 formed in the exterior surface. The second part 202B has a plurality of fingers 218 formed at an end 220 of the second part 202B to engage with the plurality of catches 216 when the second part 202B is fitted together with the first part 202A. The second part 202B is moved along the first part 202A, which slides within the second part 202B in a telescoping fashion. As the second part 202B is moved, the end 220 of the second part 202B generally contacts the second lead 122 and accomplishes bending the second lead 122 between the interior surface of the second part 202B and the exterior surface of the first part 202A in an axial direction of the housing 202. The second lead 122 thus contacts the second part 202B on the interior surface thereof. As the second part 202B is moved along the first part 202A, after the second lead 122 is bent into contact with the second part 202B, the fingers 218 engage with the catches 216 to secure the second part 202B in engagement with the first part 202A.

Referring now to FIG. 2B, the first part 202A has circuit guides 221 that extend from the partition 206 in an axial direction of the housing 202 into the electrical connection chamber 210. The circuit guides 221, in this case, help to position the power contact 207 in a generally concentric relationship to the housing 202. The circuit guides 221, here, are disposed in a radially uniform pattern within the electrical connection chamber 210. The power contact 207 is disposed within the electrical connection chamber 210 around the circuit guides 221, which generally position the power contact 207 in a concentric arrangement with the housing 202.

The power contact 207 is generally spring-shaped with loops that progress in a circumferential manner to define a generally cylindrical shape. The power contact 207 has a radial extension 222 at an end thereof to simplify forming an electrical connection between the power contact 207 and the first lead 118. The radial extension 222 extends to a central axis of the housing 202, and in some cases slightly beyond the central axis of the housing 202, to facilitate making electrical contact with the first lead 118, which is located generally at, or close to, the central axis of the housing 202 when the ignition circuit 104 is installed. The power contact 207 can be rotated upon insertion to bring the radial extension 222 into close proximity, or into contact, with the first lead 118. A conductive material, such as solder or conductive epoxy, can be used to secure electrical connection between the radial extension 222 of the power contact 207 and the first lead 118. Using a power contact like the power contact 207 enables making the electrical connection using less conductive material in the electrical connection chamber 210.

In this case, the second part 202B is made of metal to provide a path to ground for the ignition circuit 104. The second part 202B could also be made of plastic and lined with metal on the interior thereof, for example using a metal coating or foil adhered to the interior of the second part 202B. It should be noted that the ground member 150 of the igniter 100 could also be a plastic part with a metal coating or foil adhere to the interior thereof to provide the ground pathway. In general the ground pathway member can be made of any material that provides electrical conductivity and connectivity with the ignition circuit. These can be metal members or metal coated plastic members, as described above. Such components can also be made of conductive polymers, which can be, or can include, organic conductive materials. Such components can also be made of non-conductive polymers infused, impregnated, doped, or composited with conductive materials, which can be metallic or non-metallic.

The cylindrical form shown in the embodiments herein is often convenient, but other forms can be used depending on the needs of particular applications. Rectangular forms, or other polygonal forms, can be used. Rather than a circular cylinder, an oval or stadium-shaped cylindrical form can be used.

The ground member shown herein is generally cylindrical and has a functional aspect like a sleeve that fits over the housing, or over a portion of the housing. In the embodiment of FIG. 1D, the ground member is a metallic sleeve. In the embodiment of FIGS. 2A and 2B, the ground member is the second housing part 202B, or a portion thereof such as one of the fingers 218. The ground member can take other forms. For example, instead of a sleeve the ground member could be a bracket that fits over the housing in a way that electrically connects to the ignition circuit and provides ground pathway for the ignition circuit. In some cases, the ground member could be a part of an outer casing that contains the housing or the entire igniter. In other cases, the ground member could be a circuit, or just a wire, that is disposed within the material of the housing, for example a wire that is overmolded within the plastic of the housing to make contact with the second lead.

In certain embodiments of the present disclosure, an igniter includes a housing having a first part with a circuit guide and a second part that fits together with the first part to form the housing. The first part and the second part define an interior of the housing, with the circuit guide located in the interior of the housing. The igniter also includes an ignition circuit having a heating element disposed within the interior of the housing, a first lead, and a second lead that extends outside of the housing. The igniter also includes a power contact electrically connected to the first lead through a power opening in the housing, and a ground member disposed around the housing in electrical contact with the second lead.

In some embodiments, the first part and the second part define two parts of a cylinder divided longitudinally. In some embodiments, the housing has a partition that divides the interior into an electrical connection chamber and a combustion chamber. In some embodiments, the circuit guide is located in the electrical connection chamber and the power contact is electrically connected to the first lead within the electrical connection chamber. In some embodiments, the first lead extends from the power contact, through a lead opening in the partition, to the heating element. In some embodiments, the housing has a ground opening that provides a passage for the second lead from the combustion chamber to an exterior of the housing. In some embodiments, the first lead extends from the power contact, through a lead opening in the partition, to the heating element. Each of the lead opening the ground opening is defined by a first feature in the first part of the housing and a second feature in the second part of the housing, and the first part and the second part fit together to form the lead opening and the ground opening.

In some embodiments, the housing has a partition that divides the interior into an electrical connection chamber and a combustion chamber, and the power opening is an opening at an end of the electrical connection chamber. In some embodiments, the circuit guide is located in the electrical connection chamber and the first part and the second part are connected in a clamshell configuration. In some embodiments, the partition has a lead opening that provides a passage between the electrical connection chamber and the combustion chamber. The first lead is electrically connected with the power contact in the electrical connection chamber, and the first lead extends through the lead opening to the heating element in the combustion chamber. In some embodiments, the second lead extends from the heating element in the combustion chamber through a ground opening of the housing to an exterior of the housing. In some embodiments, the second lead contacts the ground member at the exterior of the housing.

In certain embodiments of the present disclosure, an igniter includes a housing having a first part and a second part that are separable and define an interior of the housing. The housing has a partition in the interior of the housing that defines an electrical connection chamber within the interior to provide electrical connection to a power source and a combustion chamber within the interior to contain a combustible material. The partition has a lead opening that provides a passage between the electrical connection chamber and the combustion chamber. The igniter also has a heating element, a first lead, and a second lead. The ignition circuit is disposed within the interior of the housing with the heating element located within the combustion chamber and the first lead extending through the lead opening of the partition into the electrical connection chamber. The igniter also has a power contact disposed within the electrical connection chamber that extends outside the housing through a power opening of the housing, and electrically connects to the first lead. The igniter also has a ground member electrically connected to the second lead.

In some embodiments, the first part and the second part define two parts of a cylinder divided longitudinally. In some embodiments, the electrical connection chamber has a circuit guide. In some embodiments, the ground member is disposed around the housing and captures the second lead between the ground member and the housing. In some embodiments, the first part and the second part are connected in a clamshell configuration.

In certain embodiments of the present disclosure, an igniter includes a housing have a first part and a second part. The first part and the second part define two parts of a cylinder divided longitudinally and are connected along a long edge thereof in a clamshell configuration. The first part and the second part define an interior of the housing. The housing has a partition in the interior of the housing that defines an electrical connection chamber within the interior to provide electrical connection to a power source and combustion chamber within the interior to contain a combustible material. The partition has a lead opening that provides a passage between the electrical connection chamber and the combustion chamber in an axial direction. The housing has a ground opening in a side wall thereof that provides a passage from the combustion chamber to an exterior of the housing in a radial direction. The igniter also includes an ignition circuit that has a heating element, a first lead, and a second lead. The ignition circuit is disposed within the interior of the housing with the heating element located within the combustion chamber. The first lead extends through the lead opening of the partition into the electrical connection chamber, and the second lead extends through the ground opening. The igniter also includes a power contact disposed within the electrical connection chamber. The power contact extends outside the housing through a power opening of the housing, and electrically connects with the first lead. The igniter also includes a ground member electrically connected with the second lead. In some embodiments, the ground member is a metallic sleeve disposed around the housing in electrical contact with the second lead.

While the foregoing is directed to embodiments of the present invention, other and further embodiments of the present disclosure may be devised without departing from the basic scope thereof, and the scope thereof is determined by the claims that follow. Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded. In the claims, means-plus-function clauses are intended to cover the structures described herein as performing the recited function and not only structural equivalents, but also equivalent structures. It is the express intention of the applicant not to invoke 35 U.S.C. § 112, paragraph 6 for any limitations of any of the claims herein, except for those in which the claim expressly uses the words "means for" together with an associated function.

What is claimed is:

1. An igniter, comprising:

a housing having a first part with a circuit guide and a second part that fits together with the first part to form the housing, the first part and the second part defining an interior of the housing, with the circuit guide located in the interior of the housing;

an ignition circuit having a heating element disposed within the interior of the housing, a first lead, and a second lead, the second lead extending outside the housing;

a power contact electrically connected to the first lead through a power opening in the housing; and a ground member disposed around the housing in electrical contact with the second lead, wherein the housing has a partition that divides the interior into an electrical connection chamber and a combustion chamber, and wherein the housing has a ground opening that provides a passage for the second lead from the combustion chamber to an exterior of the housing.

2. The igniter of claim 1, wherein the first part and the second part define two parts of a cylinder divided longitudinally.

3. The igniter of claim 1, wherein the circuit guide is located in the electrical connection chamber and the power contact is electrically connected to the first lead within the electrical connection chamber.

4. The igniter of claim 3, wherein the first lead extends from the power contact, through a lead opening in the partition, to the heating element.

5. The igniter of claim 1, wherein the first lead extends from the power contact, through a lead opening in the partition, to the heating element, and wherein each of the lead opening and the ground opening is defined by a first feature in the first part of the housing and a second feature in the second part of the housing, and the first part and the second part fit together to form the lead opening and the ground opening.

6. The igniter of claim 2, wherein the power opening is an opening at an end of the electrical connection chamber.

7. The igniter of claim 6, wherein the circuit guide is located in the electrical connection chamber and the first part and the second part are connected in a clamshell configuration.

8. The igniter of claim 6, wherein the partition has a lead opening that provides a passage between the electrical connection chamber and the combustion chamber, the first lead is electrically connected with the power contact in the electrical connection chamber, and the first lead extends through the lead opening to the heating element in the combustion chamber.

9. The igniter of claim 8, wherein the second lead extends from the heating element in the combustion chamber through the ground opening of the housing to the exterior of the housing.

10. The igniter of claim 9, wherein the second lead contacts the ground member at the exterior of the housing.

11. An igniter, comprising:

a housing having a first part and a second part, the first part and the second part being separable and defining an interior of the housing, the housing having a partition in the interior of the housing that defines an electrical connection chamber within the interior to provide electrical connection to a power source and a combustion chamber within the interior to contain a combustible material, the partition having a lead opening that provides a passage between the electrical connection chamber and the combustion chamber;

an ignition circuit having a heating element, a first lead, and a second lead, the ignition circuit disposed within the interior of the housing with the heating element located within the combustion chamber, the first lead extending through the lead opening of the partition into the electrical connection chamber, and the second lead extending from the heating element in the combustion chamber through a ground opening of the housing to an exterior of the housing;

a power contact disposed within the electrical connection chamber, extending outside the housing through a power opening of the housing, and electrically connected with the first lead; and a ground member electrically connected with the second lead.

12. The igniter of claim 11, wherein the first part and the second part define two parts of a cylinder divided longitudinally.

13. The igniter of claim 11, wherein the electrical connection chamber has a circuit guide.

14. The igniter of claim 11, wherein the ground member is disposed around the housing and captures the second lead between the ground member and the housing.

15. The igniter of claim 11, wherein the first part and the second part are connected in a clamshell configuration.

16. An igniter, comprising:

a housing having a first part and a second part, the first part and the second part defining two parts of a cylinder divided longitudinally and being connected along a long edge thereof in a clamshell configuration, the first part and the second part defining an interior of the housing, the housing having a partition in the interior of the housing that defines an electrical connection chamber within the interior to provide electrical connection to a power source and a combustion chamber within the interior to contain a combustible material, the partition having a lead opening that provides a passage between the electrical connection chamber and the combustion chamber in an axial direction, the housing having a ground opening in a side wall thereof that provides a passage from the combustion chamber to an exterior of the housing in a radial direction;

an ignition circuit having a heating element, a first lead, and a second lead, the ignition circuit disposed within the interior of the housing with the heating element located within the combustion chamber, the first lead extending through the lead opening of the partition into the electrical connection chamber, and the second lead extending through the ground opening;

a power contact disposed within the electrical connection chamber, extending outside the housing through a power opening of the housing, and electrically connected with the first lead; and a ground member electrically connected with the second lead.

17. The igniter of claim 16, wherein the ground member is a metallic sleeve disposed around the housing in electrical contact with the second lead.

* * * * *